United States Patent [19]

Gebhardt et al.

[11] Patent Number: 4,787,112

[45] Date of Patent: Nov. 29, 1988

[54] EDGE BRUSH FOR ELECTROPLATED STRIP

[75] Inventors: Edwin J. Gebhardt, Center Township, Porter County; George H. Keaton; Michael M. Sinar, both of Porter Township, Porter County, all of Ind.; James N. Wendt, Oakland County, Mich.

[73] Assignee: USX Corporation, Pittsburgh, Pa.

[21] Appl. No.: 90,482

[22] Filed: Aug. 28, 1987

[51] Int. Cl.[4] ..... A46B 13/02

[52] U.S. Cl. ..... 15/77; 15/21 C; 15/53 B; 29/81 H; 51/112; 409/138

[58] Field of Search ..... 15/77, 21 C, 21 R, 21 D, 15/102, 53 B, 88; 51/110, 112; 29/81 H, 90 R; 144/118; 409/138, 139, 140

[56] References Cited

U.S. PATENT DOCUMENTS

| | | | |
|---|---|---|---|
| 1,473,060 | 11/1923 | Taylor . | |
| 1,494,152 | 5/1924 | Cowper-Coles . | |
| 2,203,253 | 6/1940 | Brown | 204/6 |
| 2,386,663 | 10/1945 | Deans | 15/3 |
| 2,845,755 | 8/1958 | Price | 51/112 |
| 3,416,207 | 12/1968 | Maida | 29/25.42 |
| 3,561,032 | 2/1971 | Kasnyik et al. | 15/77 |
| 3,762,273 | 10/1973 | Sprung | 144/118 |
| 4,192,037 | 3/1980 | Capra | 15/53 B |
| 4,550,464 | 11/1985 | Messing | 15/53 B |
| 4,724,571 | 2/1988 | Mlinek, Jr. | 15/21 D |

FOREIGN PATENT DOCUMENTS

| | | | |
|---|---|---|---|
| 0742048 | 7/1980 | U.S.S.R. | 15/21 C |

*Primary Examiner*—Edward L. Roberts
*Attorney, Agent, or Firm*—W. F. Riesmeyer, III

[57] ABSTRACT

Apparatus is disclosed for brushing the edges of electroplated metal strip to remove excess plating metal therefrom. In a first embodiment for brushing the narrow face edges of the strip, a cup brush is mounted on a carriage having a motor thereon for rotatably driving the brush. The carriage is slidably movable in a transverse direction of the strip. A device urges the carriage inwardly toward the strip so that the brush is maintained in constant contact with uniform pressure against the strip edge. In a second embodiment for brushing the broad surfaces of the strip adjacent to the strip edge, a disc brush is mounted on a carriage having a motor thereon for rotatably driving the brush. Again, the carriage is slidably movable in a transverse direction of the strip. A device urges the carriage inwardly toward the strip so that the brush is maintained in constant contact with a uniform portion of the width of the strip near the edge thereof. A second device is provided for maintaining the pressure exerted by the brush against the strip substantially constant. In a preferrred form, a device is provided for removal and collection of plated metal particles brushed from the strip.

8 Claims, 10 Drawing Sheets

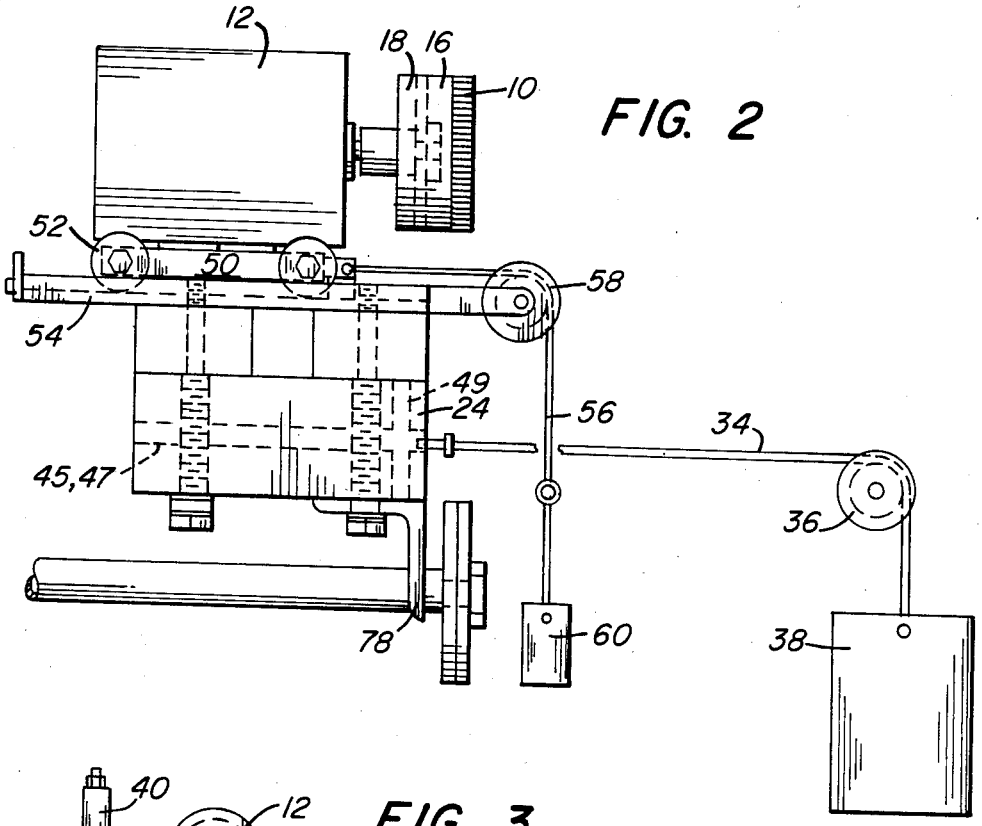
FIG. 2
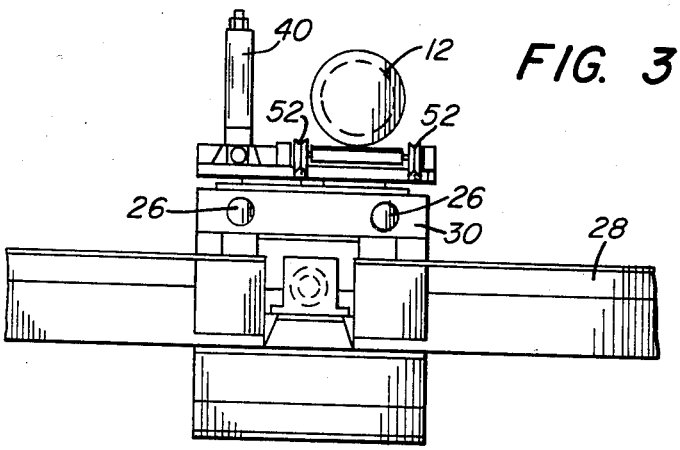
FIG. 3
FIG. 4
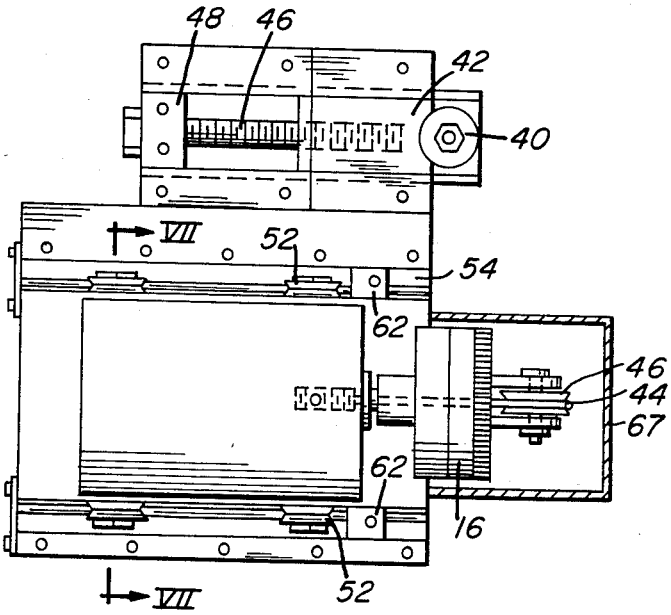

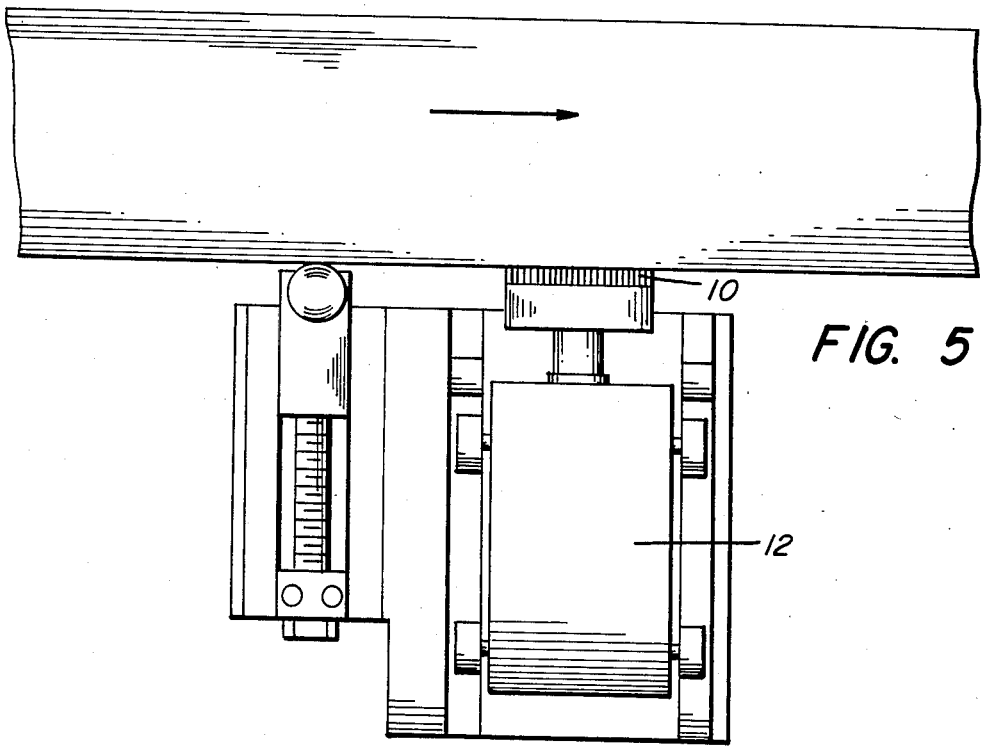
FIG. 5
FIG. 6
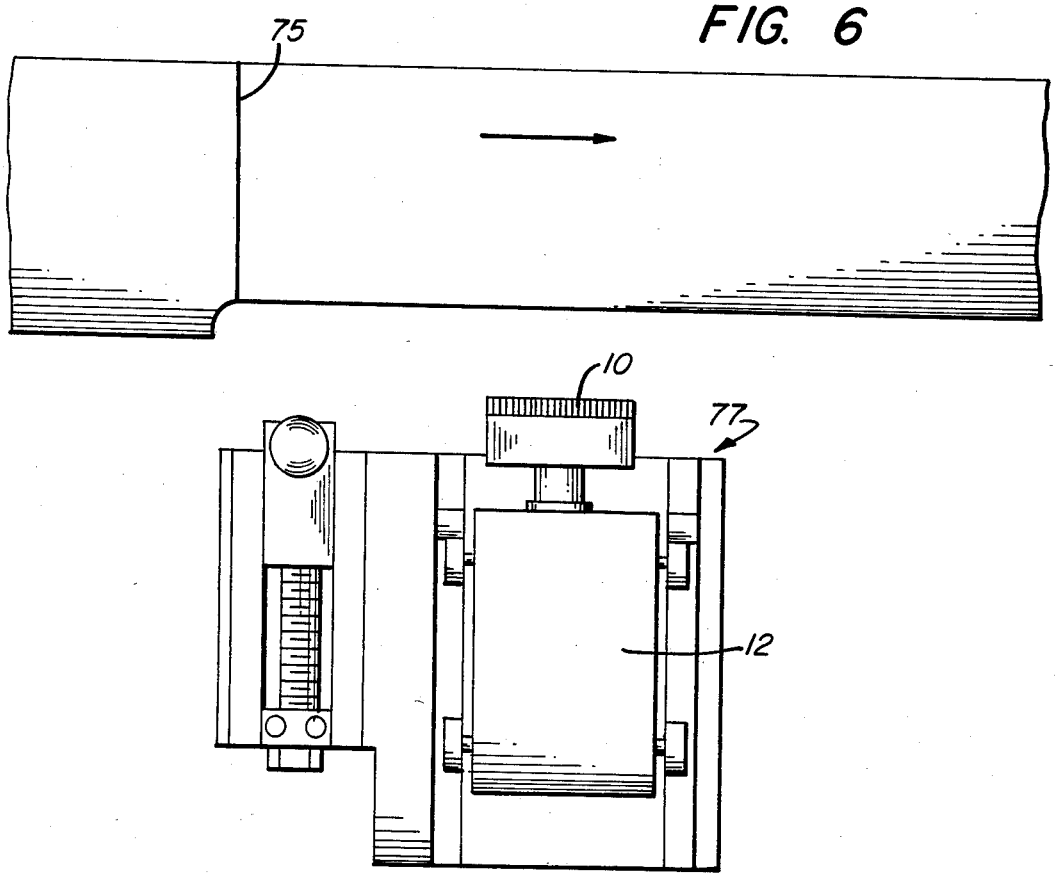

EDGE BRUSH FOR ELECTROPLATED STRIP

BACKGROUND OF THE INVENTION

The present invention is related to a method and apparatus for removing excess plating metal from the edges of electroplated metal strip, and particularly to a method and apparatus for removing excess plated zinc, zinc oxide or zinc alloy from top and bottom surfaces of electrogalvanized steel strip adjacent to the edges thereof and from the narrow face of the strip edges by brushing both the top and bottom surfaces near the edges and the narrow face edge portions of said strip.

In the various processes for the electrodeposition of zinc, zinc oxide or zinc alloys onto steel strip, there is an inherent tendency regardless of the process used to form an excess thickness of plated zinc on the narrow face of the strip edges. The excess thickness of plated zinc results from higher current densities at the narrow face edge of the strip than on the broad strip surface. The higher current density also causes the excess plated zinc to be porous and less adherent to the strip than the more dense uniform plated coating on the broad strip surfaces. If not previously removed, the excess zinc tends to flake and fall off in stamping dies used to form automotive body parts and cause dimples making the stamped parts unusable. In addition, in some electrodeposition processes, zinc is plated onto the top and bottom broad surfaces of the strip near the strip edges particularly on heavier gauge steel strip or that which is side trimmed and does not have a tapered decreasing thickness profile near the strip edges prior to plating. The excess plated zinc on the top and bottom broad surfaces near the edges tends to cause flaring or buildup on the edges of coils wound from the plated strip. This again is a condition that is not acceptable to the customer. For the most critical applications, the customer may request that the plated strip be side trimmed to remove the edges having excess plated metal thereon in order to eliminate the problems it causes them in subsequent operations. This can result in a yield loss of up to 5% significantly increasing cost and causing loss of profit for the steel manufacturer.

U.S. Pat. No. 2,386,663, Deans, discloses an improvement in an edge scraper for removing excess plating metal from the edges of electrolytic tin plated steel strip. This is accomplished by the application of a self-adjusting cutter to the plated strip edges. The cutter includes a freely rotatable hardened steel wheel mounted transversely of the strip on a carriage having wheels riding on longitudinal rails also extending in a transverse direction with respect to the strip. The wheel is urged with equal cutting pressure at all times against the strip by a cable weight and pulley arrangement mounted on the carriage. Air nozzles directed toward the strip edges remove particles of plating metal scraped from the strip and direct them to box-like collectors substantially enclosing the wheels. The collectors are connected to discharge chutes leading to a hopper beneath the carriage base. The problem with this roll-type cutter and other types of cutters such as blade cutters is that plating metal tends to buildup on the cutting face very quickly dulling the cutting tool. Once dull, the tool tends to smear the plated metal producing a rough edge which can lead to customer rejections.

It is also known to use a drag bar or a rotating roll for the purpose of removing excess zinc from the edge of electrogalvanized steel strip. The drag bar smears the zinc particles across the strip edge and extrudes the zinc above and below the strip thickness resulting in flared edges on coils wound from the strip and customer rejection. Drag bars also distort and produce a rough edge. Similarly, the rotating roll compresses loose zinc particles on the edge and distorts and smears the zinc also. The compressed zinc particles tend to fall off as dust and get into stamping dies and onto the strip surface as mentioned above. Also, the smeared zinc provides a rough and flared edge on the coils.

In the manufacture of a metal foil, the burnishing or buffing of the foil after it is electrodeposited onto a mandrel is disclosed in U.S. Pat. No. 2,203,253. This reference discloses a steel roll which contacts the foil and is rotatably driven at a speed about 15% higher than the surface speed of the mandrel so as to smooth the spongy outer surface of the metal foil electrodeposited thereon. U.S. Pat. No. 3,416,207 discloses in the making of electrical capacitors complete removal of a portion of a plated metal surface by grinding.

U.S. Pat. No. 1,473,060, Taylor, discloses a brush which is mounted in a plating tank so as to revolve around a cylindrical cathode immersed in the bath and remove bubbles and solid impurities from the plated deposit on the cathode. The purpose is to prevent the formation of pits in the plated surface. The brushing is done only intermittently for short periods between rather longer periods in which the bath and article to be plated are permitted to remain quiescent. Also, a brush is disclosed in U.S. Pat. No. 1,494,152, Cowper-Coles, in a method of making wire by electrodeposition of metal onto a rotating cylinder. On an upper surface of the horizontal cylinder which is above the level of the bath, a brush is located to brush the deposit as it emerges from the electrolyte. The purpose of the brush is not specifically disclosed. It appears to be a stationary, non-rotatable type for sweeping foreign particles from the plated deposit.

SUMMARY OF THE INVENTION

Applicants have found that excess plating metal on the edges of electrolytically plated strip can best be removed without damage to the underlying adherently bonded plated metal surface by brushing. Furthermore, by selection of bristle size, type of bristle material, and brush configuration, the surface of the underlying adherently bonded plated metal can be smoothed, rounded, and polished to provide a better shape configuration at the strip edges. Finally, Applicants have provided improved apparatus for removal and collection of fine plated particles from the strip so as to prevent adherence of those particles to the strip after brushing. The brushing apparatus also has a specially designed set of tracks to prevent plated metal particles from collecting on the tracks and interfering with travel of the brush back and forth thereon.

BRIEF DESCRIPTION OF THE DRAWINGS

FIG. 2 is a side elevational view taken at II—II of FIG. 1.

FIG. 3 is an end view taken at III—III of FIG. 1.

FIG. 4 is an enlarged plan view of one of the brush devices shown in FIG. 1.

FIG. 5 is a schematic plan view similar to FIG. 4 showing one of the brush devices in position for brushing the narrow face edge of plated strip.

FIG. 6 is a schematic plan view similar to FIG. 5 showing one of the brush devices in the retracted position to allow a weld in the strip to pass by without harm to the brush.

DESCRIPTION OF THE PREFERRED EMBODIMENT

Figure 1:
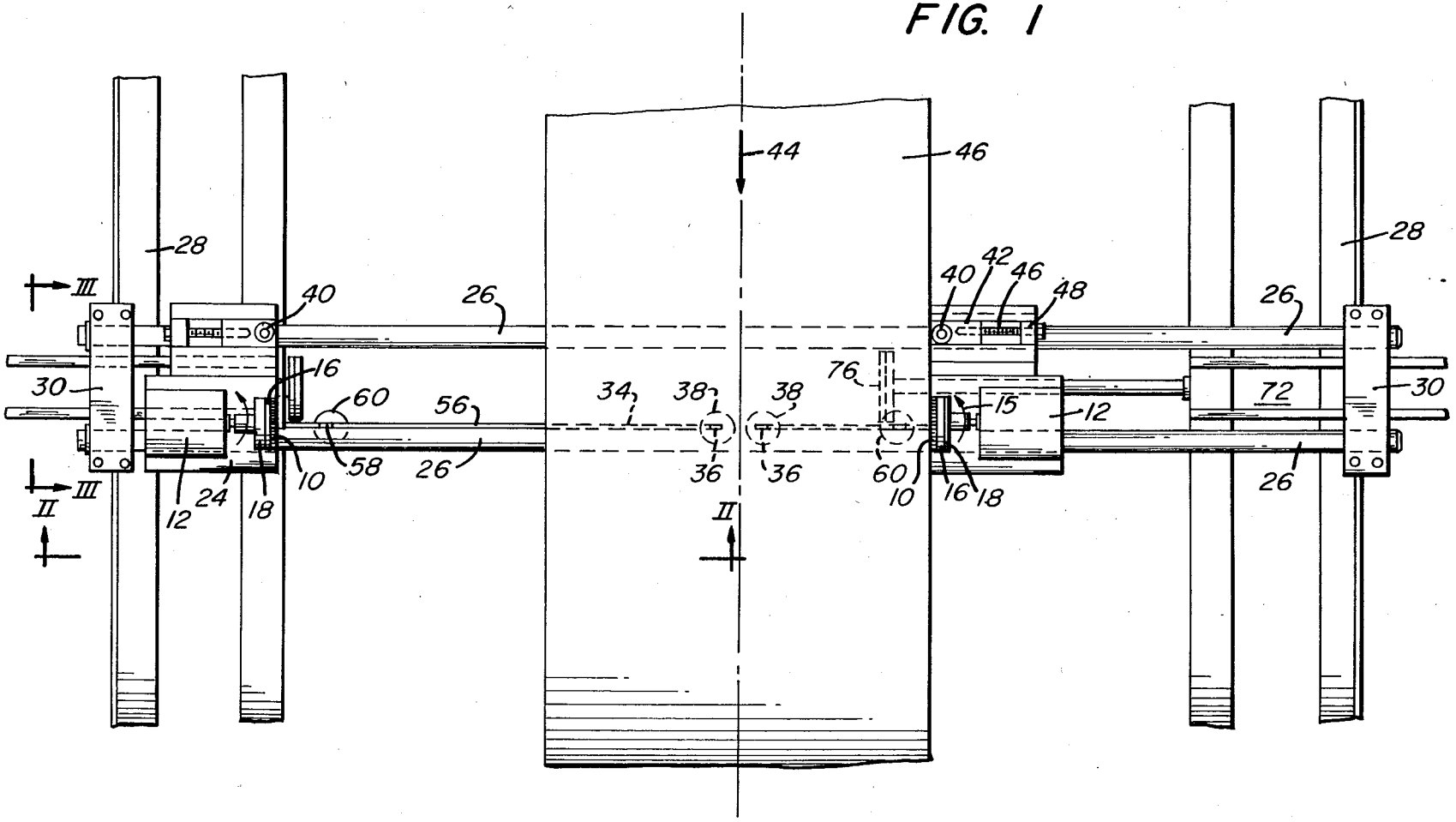
FIG. 1 is a plan view of a first embodiment of the apparatus of this invention with the brush cover removed, said apparatus of the first embodiment being adapted for brushing the narrow face edges of plated strip.

Referring to FIG. 1, a first embodiment of the apparatus of this invention is shown. The apparatus of this embodiment is directed to brushing the narrow face edges of, for example, electrogalvanized steel strip as it travels through the electrogalvanizing line after emerging from the electroplating bath. The apparatus includes a cup brush 10 rotatably driven by electric motor 12. The cup brush has bristles or filaments (as they are commonly referred to in the industry) arranged in an annular ring shape. The filaments extend longitudinally in a direction generally parallel to the axis of the ring. This type of brush has particular advantage in that on each rotation it drags the filaments downwardly across a top surface of the narrow face of the strip edge and upwardly across a bottom surface of the narrow face thereof. This produces a rounded surface on the edge which is very desirable. Preferably, the cup brush is rotated in direction 15, i.e. hitting the top of the strip against the direction of strip travel. This direction of rotation produces a more aggressive wiping of the edge by the brush and produces a more rounded shape as just mentioned. Thus, brushes on opposite sides of the strip rotate preferably in opposite directions as viewed from behind the brush looking toward the strip. The filaments are of steel wire material having a diameter preferably within the range of 0.002 to 0.012 inches, more preferably 0.004 to 0.008 inches. Sleeve 16 is provided to limit the exposed length of the filaments to not more than ¾ inch. The sleeve may be of metal or plastic material but is preferably secured to back plate 18 of the brush. The motor is driven so as to rotate the brush at speeds within the range of 1000 to 3400 rpm preferably 1200 to 2400 rpm. Cup brushes of the type described above are readily available on the market, for example, from the Osborn Company of Cleveland, Ohio.

Figure 7:
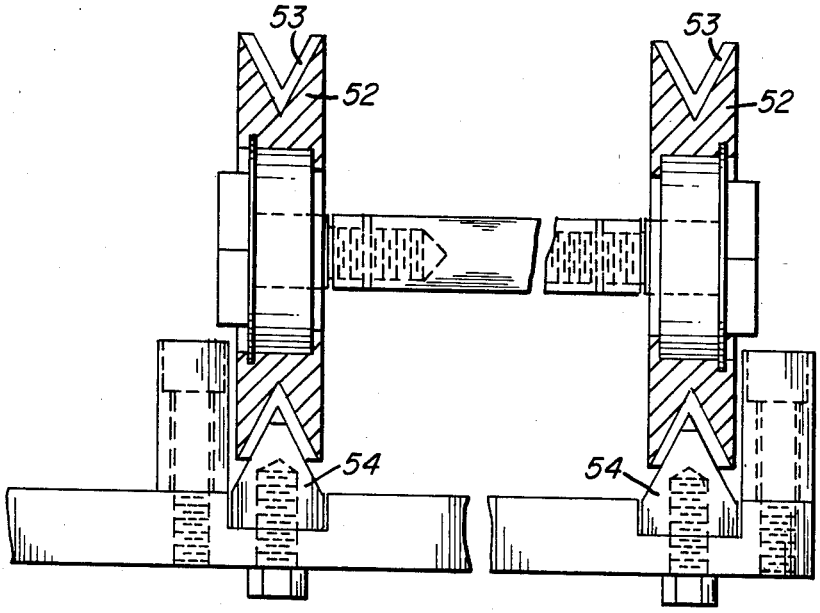
FIG. 7 is a sectional view taken at VII—VII of FIG. 4 to show a cross section of the wheels and tracks with the motor removed.
Figure 8:
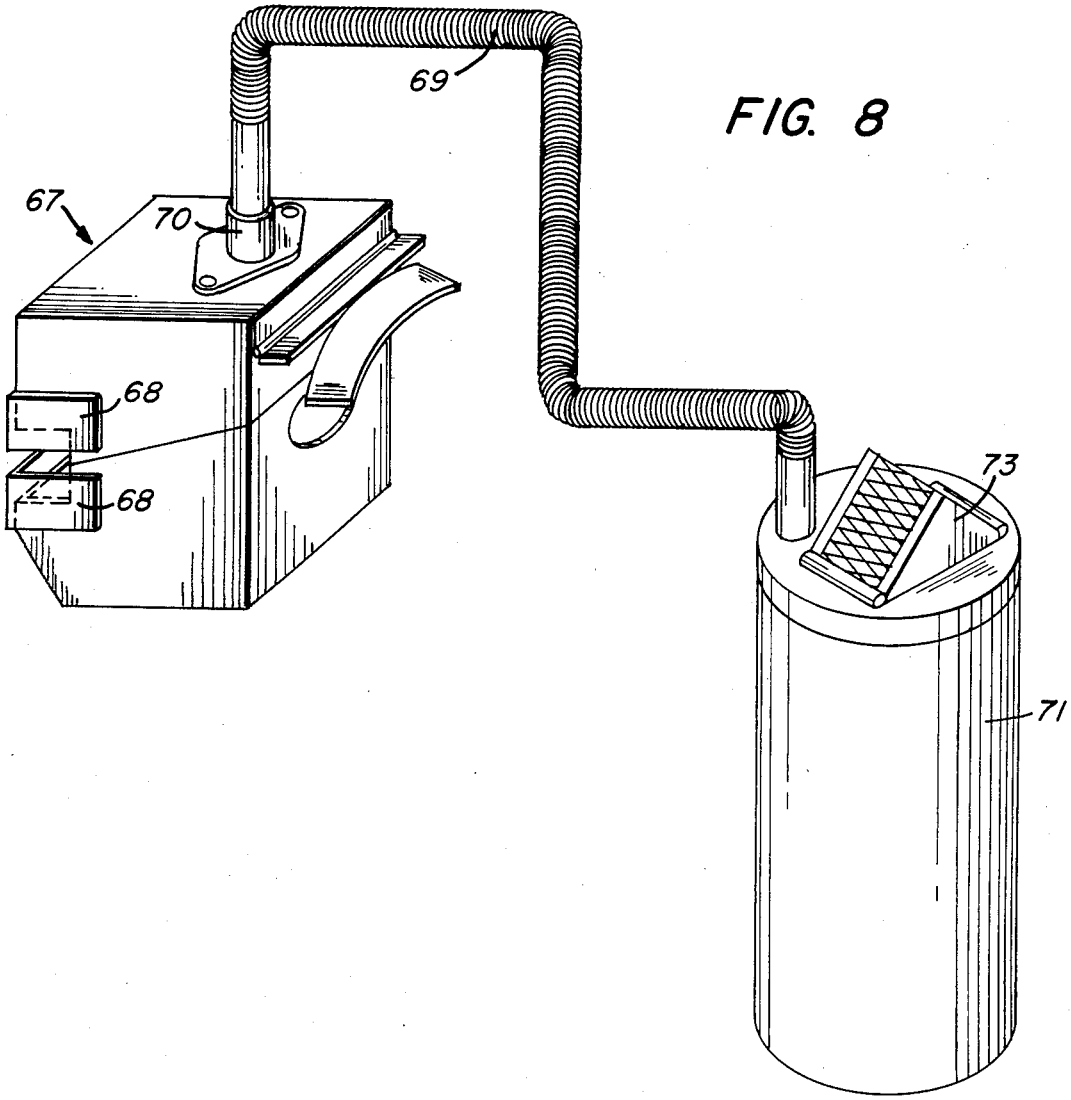
FIG. 8 is an isometric view of a cover adapted to fit over one of the brushes shown in FIG. 1 along with an exhaust line and a collection barrel for dust particles brushed from the plated strip.

Carriage 24 is provided for support of the motor and cup brush. The carriage is slidably mounted on guide rods 26 which in turn are mounted on frame 28 and secured in the frame by connector 30. The guide rods are preferably chrome-plated steel material about two-inches in diameter. And, preferably linear bearings (not shown) are provided on the carriage so that it can slide freely on the guide rods. Tracking roller 40 is rotatably mounted on slide base 42 which is adjustably movable on the carriage in a direction transverse to the direction 44 of strip travel. Bolt 46 mounted in a fixed frame portion 48 of the carriage engages a threaded bore in the slide base so that rotation of the bolt in opposite directions provides inward and outward movement of slide base 42 and tracking roller 40 thereon. The position of slide base 42 is adjusted so that when tracking roller 40 is in contact with the edge of strip the filaments of the cup brush will extend sufficiently inward across the edge of the strip to provide adequate brushing for removal of excess plated metal particles and to round the outer surface of the adherent plated metal to a desired radius so that the edge of the strip becomes smooth. Preferably, slide base 42 is adjusted so that the filaments extend about 0.0625 inches inwardly across the strip edge. Tracking roller 40 is preferably of very hard material, e.g. an AISI 4140 steel flame hardened on an outer ⅛ inch of the surface and then chrome plated to a thickness of 0.001 to 0.002 inches. Cable 34 is secured to carriage 24 by being looped through a pair of horizontal bores 45 and 47 equally spaced from the longitudinal axis of the carriage as shown in FIG. 2. The bores 45 and 47 are joined by vertical bore 49 to form a horizontal passage for the cable loop. The cable extends over pulley 46 and a large (e.g., sixteen pound) weight 38 is secured to the opposite end of cable 34. This, cable arrangement urges tracking roller 40 mounted on carriage 24 inwardly so that it remains in constant contact with the edge of the strip. This "tracks" the entire cup brush device with the strip as it moves transversely back and forth while travelling at high speed through the electrogalvanizing line. Referring again to FIG. 2, motor 12 is secured to a base 50 mounted on a set of four wheels 52 which ride on a pair of tracks 54 secured on carriage 24. The wheels have V-shaped grooves mateable with the inverted V-shape cross-section of tracks 54 (FIG. 7). Preferably, a layer 53 of polyurethane is vulcanized onto the outer surface of each wheel to provide relatively frictionless movement of the wheels on the tracks. Cable 56 is secured to base 50 and extends over pulley 58 to a relatively smaller (e.g., four pound) weight 60 which is of lesser mass than weight 48. This latter weight and cable arrangement urges motor 12 and cup brush 10 inwardly toward the strip edge. Thus, cup brush 10 is urged against the strip edge with constant pressure applied through weight 60. A pair of bumper stops 62 (FIG. 4) secured on tracks 54 prevent the brush from being moved inwardly toward the strip too far as the filaments wear. The actual spacing between the front wheels of base 50 and bumper stops 62 can be monitored by an operator periodically during operation of the brush to determine the length of exposed filaments remaining on the cup brush. As the filaments wear, the operator can determine from the spacing just mentioned when it is necessary to stop and either remove sleeve 16 to expose additional filament length or replace the cup brush completely. Electrical insulation sleeves, e.g., of teflon material, are provided at 64 and 66 on the carriage to prevent the flow of electrical current from the plated strip into the carriage in case the grounding roll (not shown) for grounding the strip is not completely effective in dissipating the electrical charge from the strip. Preferably, similar insulation sleeves (not shown) are also provided on all bolts securing the assembly for tracking roller 40 to the carriage. Cover 67 (FIGS. 4 and 8) comprised of upper and lower sections hinged together is provided for covering cup brush 10 and preventing fine particles of plated metal removed from the strip from adhering to the strip and causing problems in subsequent operations. The cover has an opening protected by rubber tape strips 68 (FIG. 8). A flexible hose 69 is connected to an air ejector 70 mounted on the top of cover 67. The hose extends to a barrel 71 for collection of the fine dust particles of plated metal. Barrel 71 has a V-shaped frame 73 mounted on its top cover with one-inch thick filters of synthetic material mounted in the frame to permit flow of air out of the barrel. A light oil is sprayed on the inner surfaces of the filter prior to its installation in the barrel to prevent escape of very fine particles in the form of dust through the filter material. A supply of compressed air (not shown) is connected to ejector 70 to withdraw particles of plated metal from the strip and pass them through the cover and flexible hose into barrel 71. In addition, pipes (not shown) are provided extending across the strip width downstream of the brush devices for directing pressurized air through spaced nozzles toward the strip to be sure that all particles of plated metal are removed therefrom. Finally, we enclose the brush devices in a covered room to completely enclose the area in which the brushes are located. A pneumatic cylinder 72 (FIG. 1) is mounted on frame 28 and has cylinder rod 74 with disc 76 attached at the remote end thereof. Disc 76 is located so as to abut angle 78 (FIG. 2) secured to carriage 24. A signal from an electric eye (not shown) actuates cylinder 72 to retract cylinder rod 74 when a weld 75 in the strip (FIG. 6) approaches the brush device. Disc 76 pulls carriage 24 outwardly to a retracted position 77 (FIG. 6) away from the strip as the weld on the strip passes by. Weight 38 automatically urges carriage 24 inwardly after the weld passes by but is restrained by disc 76 which slowly moves inward due to an air flow control valve regulating the speed of extension of cylinder rod 74 until tracking roller 40 again makes contact with the strip edge. This feature prevents tracking roller 40 from damaging the strip edge.

Figure 9:
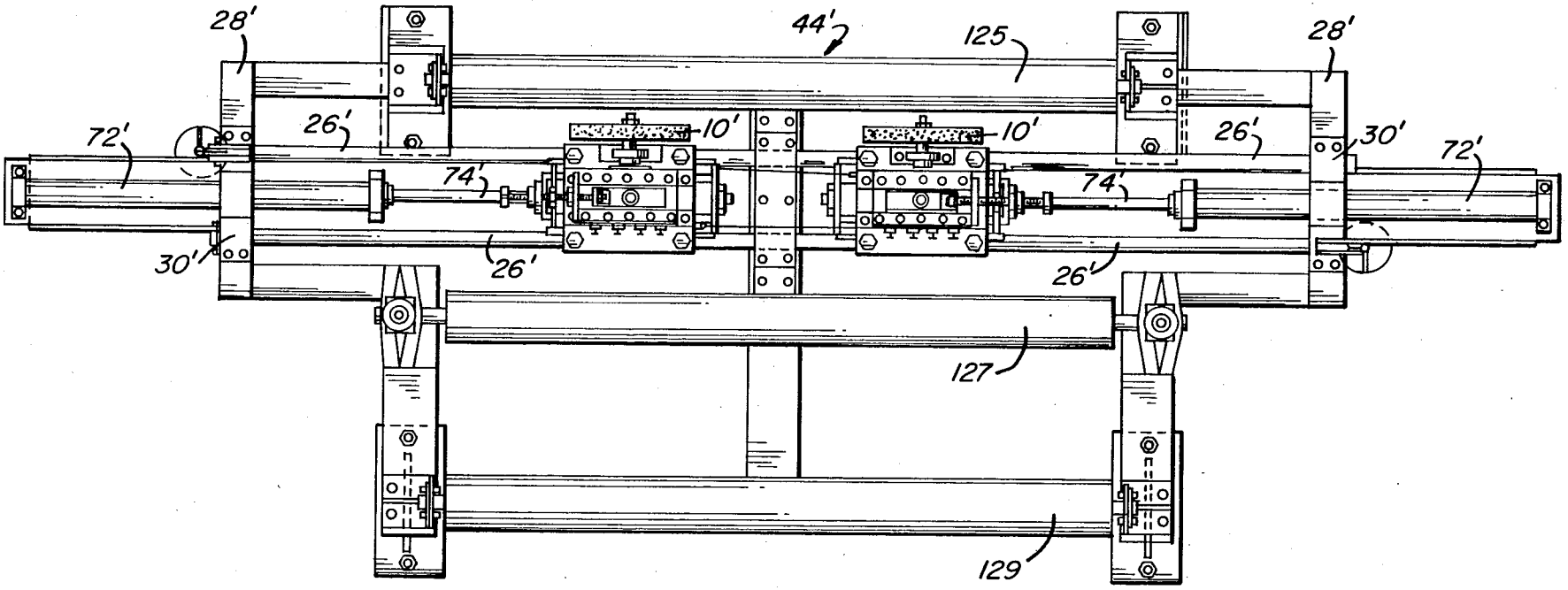
FIG. 9 is a plan view of a second embodiment of the apparatus of this invention, with the brush cover removed, said apparatus of the second embodiment being adapted for brushing the bottom surface of plated strip near the edges thereof.

In an alternative embodiment, apparatus is provided for brushing the top and/or bottom plated surfaces of the strip near, i.e. about ¼ inch of width adjacent to the edge of the strip. Referring to FIG. 9, the apparatus of this embodiment includes a disc brush 10' rotatably driven by electric motor 12'. The disc brush has abrasive impregnated nylon filaments and rotates about a central axis perpendicular to the plane of the filaments. The nylon filaments have a diameter preferably within the range of 0.030 to 0.040 inches. The filaments have an exposed length within the range of 2.000 to 2.125 inches, and face width within the range of 1.750 to 2.000 inches. A fourteen-inch diameter disc brush is suitable although other sizes may also be used. A brush number 950 of 180 grit size supplied by the Osborn Company is one that has been used successfully in our device. Preferably, the grit size should be within the range of 120 to 180, the latter being most preferred. The motor is driven so as to rotate the brush at speeds within the range of 1000 to 3400 rpm, preferably 1200 to 2400 rpm.

Figure 10:
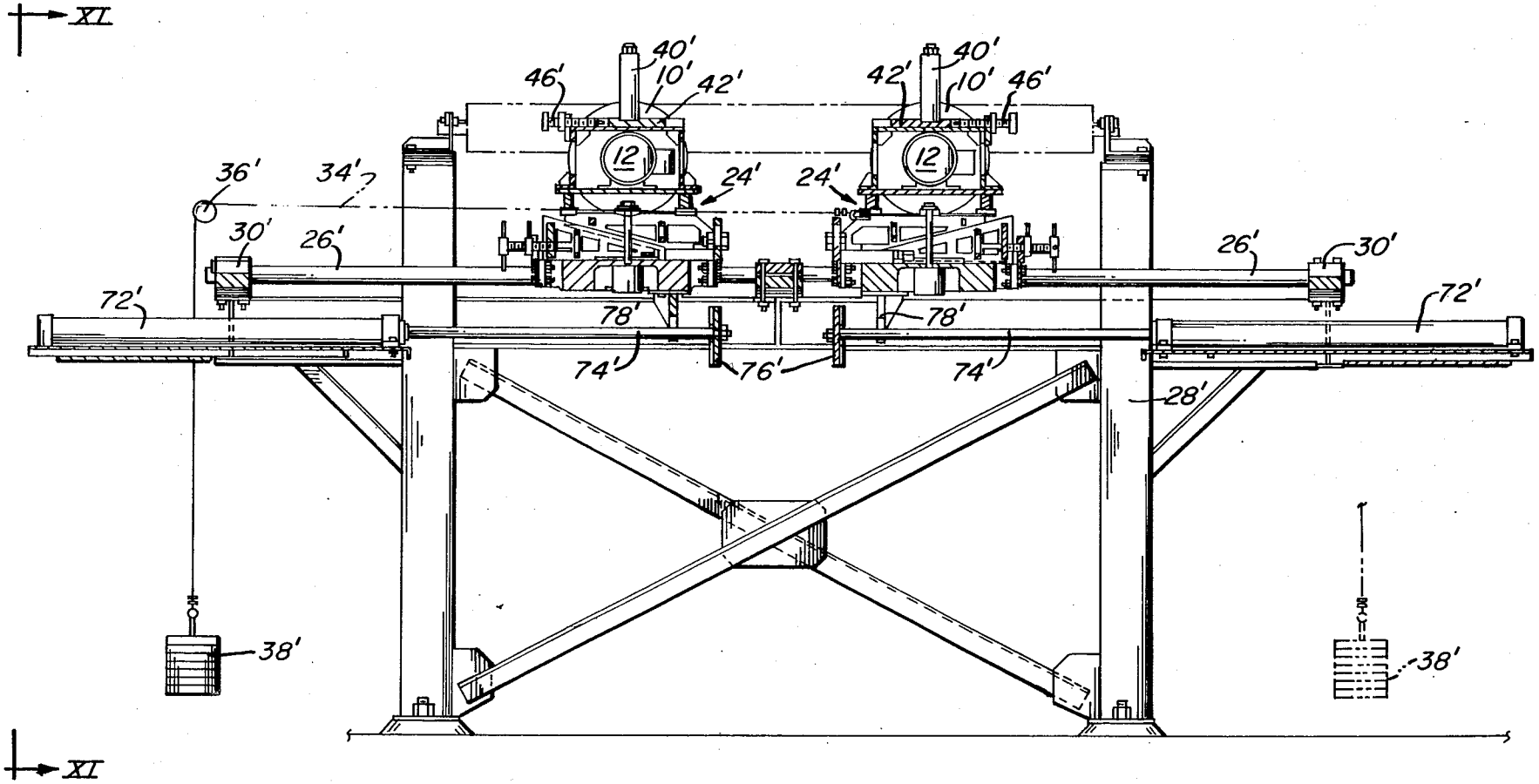
FIG. 10 is a side elevational view of the apparatus of FIG. 9.
Figure 11:
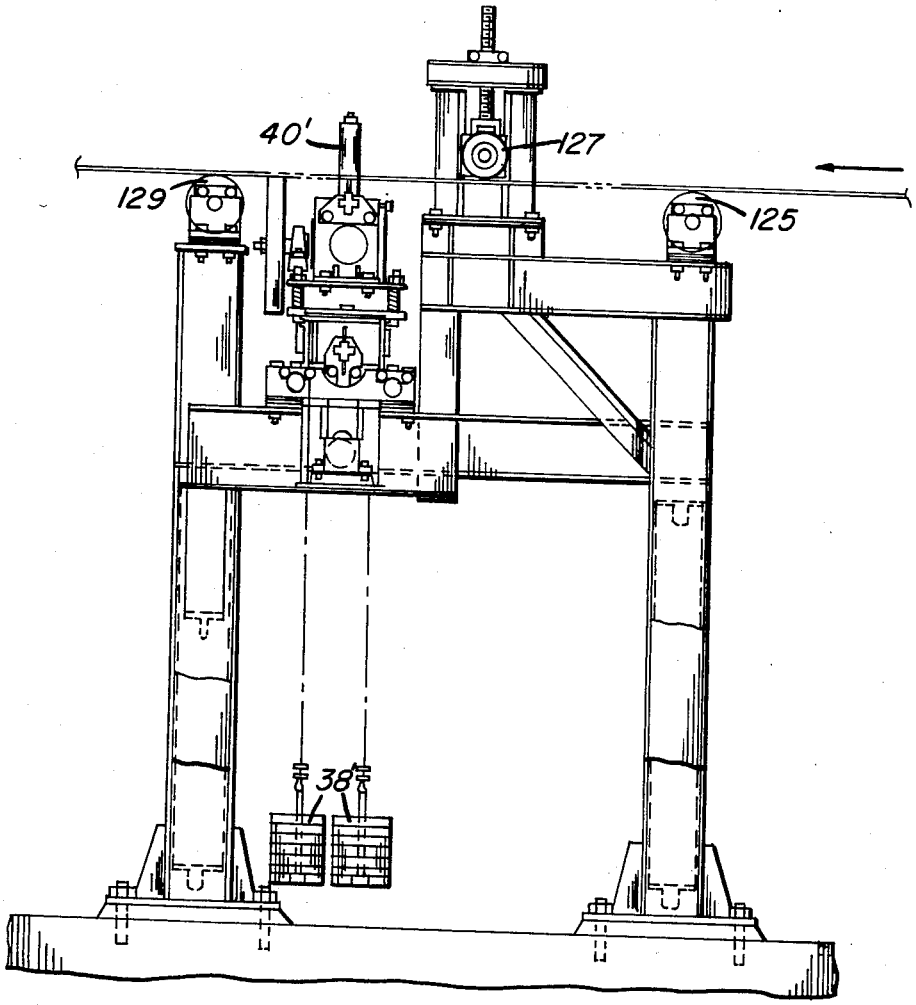
FIG. 11 is an end view taken at XI—XI of FIG. 10.
Figure 13:
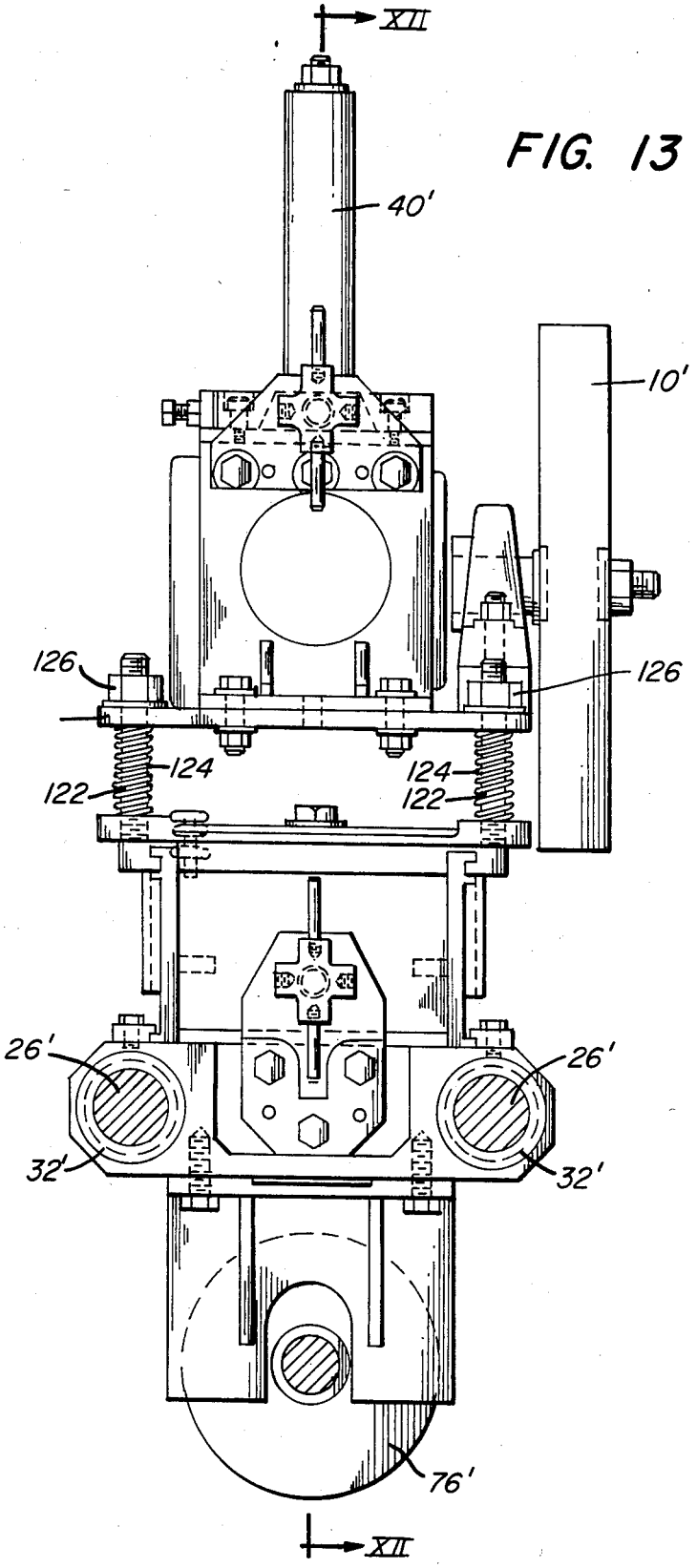
FIG. 13 is an enlarged end view of one of the brush devices of FIG. 9.
Figure 14:
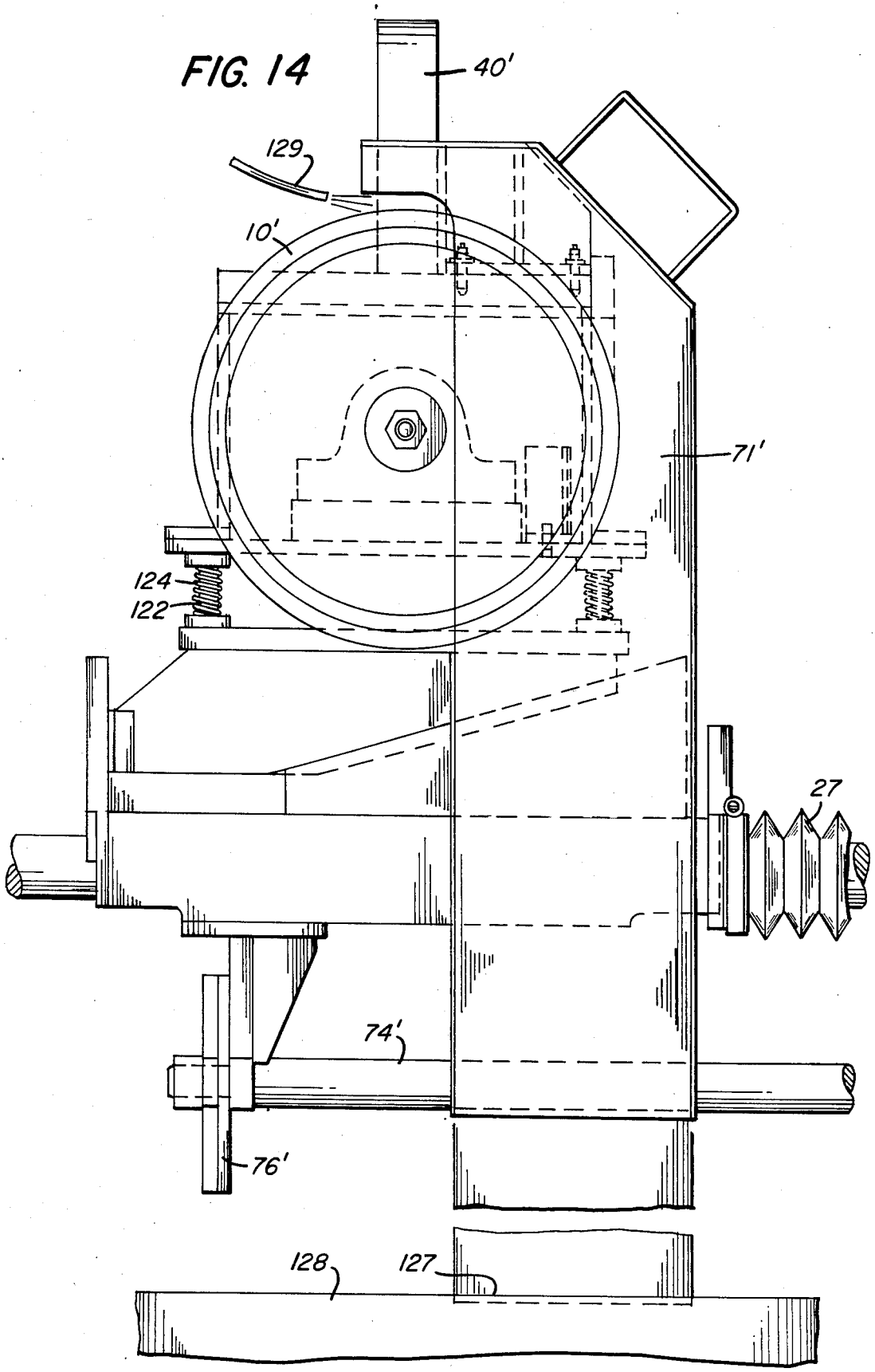
FIG. 14 is a schematic side elevational view similar to FIG. 12 showing a cover mounted on the brush device.

Carriage 24' is provided for support of the motor and disc brush. The carriage is slidably mounted on guide rods 26' which, in turn, are mounted on frame 28' and secured in the frame by connector 30'. The guide rods are of material as described with respect to the first embodiment. Preferably, the guide rods are provided with flexible covers 27 (FIG. 14) to prevent dust from collecting on the rods and interfering with travel of the carriage back and forth thereon. Similarly, linear bearings 32' (FIG. 13) are provided on the carriage so that it will slide freely on the guide rods. Tracking roller 40' (FIG. 10) is rotatably mounted on slide 42' which is adjustably movable on the carriage in a direction transverse to the direction 44' (FIG. 9) of travel of the strip (not shown since the brushes are to be under the strip in the particular arrangement illustrated). Bolt 46' (FIG. 10) engages a threaded bore in the slide to provide adjustability of the slide as previously described in the description of the first embodiment. In this embodiment, adjustment is made so that the brush contacts and wipes about the outer ¼ inch of the surface of the strip adjacent to the edge. Cable 34' is secured to carriage 24' and extends over pulley 36'. Weight 38' is secured to the opposite end of cable 34' and urges carriage 24' inwardly so that tracking roller 40' abuts the strip edge and maintains constant contact with the strip for tracking purposes as previously described.

Figure 12:
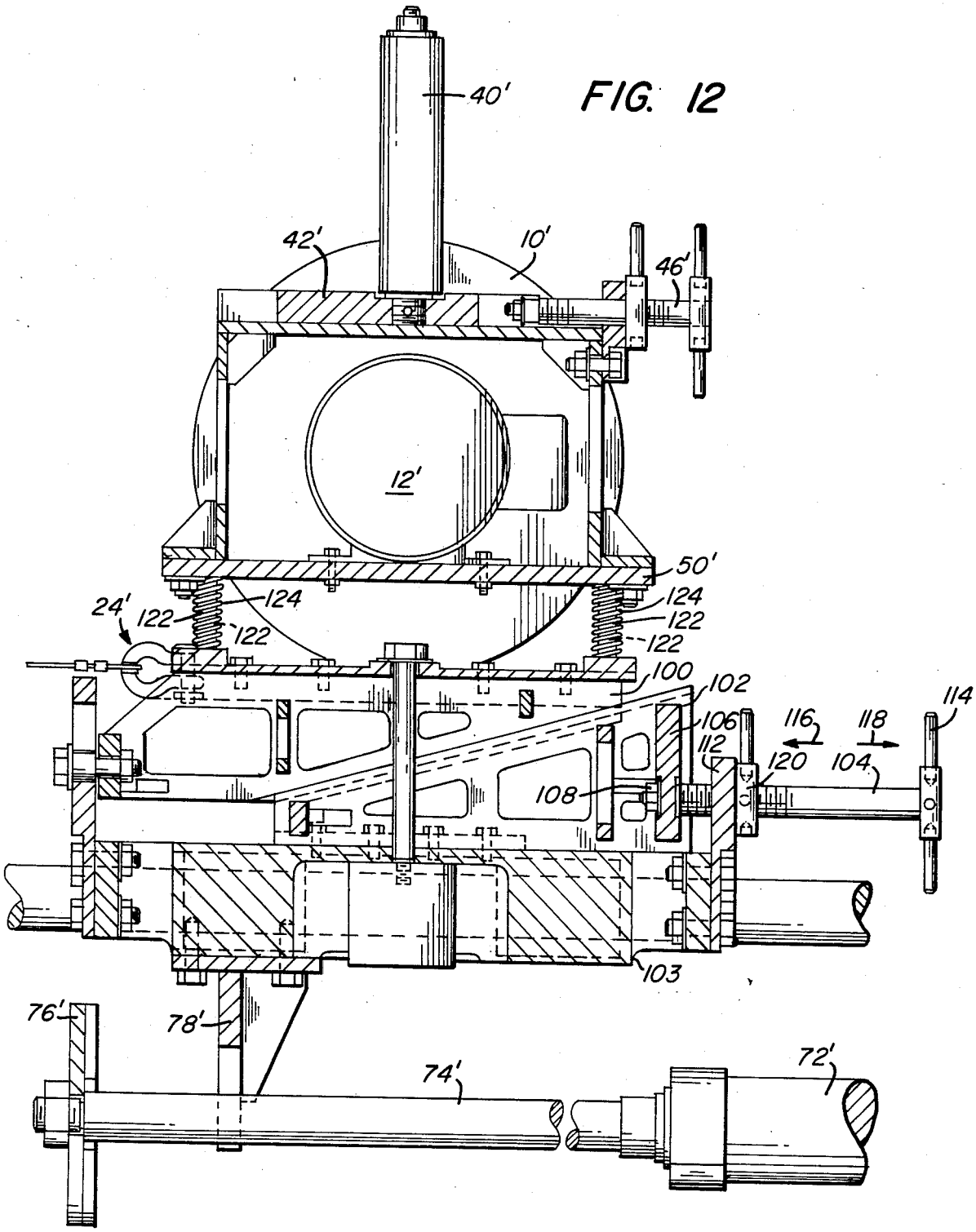
FIG. 12 is an enlarged side elevational view of one of the brush devices shown in FIG. 9.

Referring to FIG. 12, motor 12' is secured on carriage 24' which comprises a base 50' mounted on a pair of slidable mateably tapered wedges 100, 102. Wedge 100 is secured to base 50'; whereas, wedge 102 is secured to a bottom plate 103 of carriage 24'. Adjustment of wedge 102 with respect to wedge 100 is provided by threaded rod 104 secured to plate 106 of wedge 102 by nut 108. Rod 104 threadedly engages a threaded bore in plate 112 which is bolted to bottom plate 103 of carriage 24'. A handle 114 is provided on the end of rod 104 so that the rod may be rotated in opposite directions to move wedge 102 inwardly in direction 116 or outwardly in direction 118. Lock nut 120 is mounted on rod 104 to secure it in the position desired. Adjustment of the wedges raises or lowers brush 10' to position it for proper abutment against the strip. Four studs 122 extending upwardly from the top surface of wedge 100 serve as guides for compression springs 124. Nuts 126 (FIG. 13) secured on the portion of studs 122 extending through holes in base 50' provide adjustment of the force exerted by springs 124 on base 50'. Thus, by adjustment of nuts 126 and the position of wedges 100 and 102, the force exerted on brush 10' may be controlled. The springs maintain the force exerted by the brush against the strip substantially constant even though the strip tends to bounce upwardly and downwardly as it travels through the electrogalvanizing line. This bouncing tendency is, of course, minimized as much as possible through rolls 125, 127 and 129 (FIG. 9) placed adjacent to the brush machine so as to abut upper and lower surfaces of the strip. The compression springs also serve to (i) absorb shock loads due to irregularities in the strip edge; and (ii) permit independent adjustment of the brush head under the strip so that the plane of uppermost ends of the brush filaments is parallel to the plane strip travel. A cover 71' (FIG. 14) is provided which extends downwardly into a longitudinal slot 127 extending lengthwise in the horizontal direction in FIG. 12 in trough 128 that is located on the floor beneath the brush. The slot permits movement of the cover back and forth in the trough as the brushes are moved on carriage 24'. A pipe (not shown) in the bottom of trough 128 leads to a barrel (also not shown) for collection of the plated metal particles. A tube 129 is provided for directing a stream of air towards the cover. This not only directs the particles toward the cover and into the trough and barrel but also cools the brush and clears the filaments of particles o plated metal which otherwise get carried around by the brush to the other side of the strip. A pneumatic cylinder 72' (FIGS. 10 and 12) is mounted on frame 28' and has cylinder rod 74' with disc 76' attached at the remote end thereof. Disc 76' is located so as to abut angle 78' secured to carriage 24'. Again, as previously described, a signal from an electric eye (not shown) actuates cylinder 72' to retract cylinder rod 74' when a weld in the strip approaches the brush device. Disc 76' pulls carriage 24' outwardly to a retracted position away from the strip as the weld passes by. Weight 38' automatically urges carriage 24' inwardly but is restrained by disc 76' which slowly moves inward due to an air flow control valve regulating the speed of extension of rod 74' until tracking roller 40' again makes contact with the strip edge. Again, as mentioned previously, this feature prevents tracking roller 40' from damaging the strip edge.

We claim:

1. Apparatus for removing excess plated metal from the narrow face of the edges of electroplated metal strip as the strip travels through a strip processing line, said apparatus comprising:

a brush;

a carriage for supporting said brush, said carriage being slidably movable in a transverse direction with respect to the strip, means mounted on said carriage for rotatably driving said brush, means for slidably moving said carriage inwardly and permitting movement outwardly in said transverse direction to maintain said brush in contact with the narrow face of said strip edge and so that said brush exerts substantially constant pressure thereagainst, said brush comprising a cup having an outer cylindrical surface and filaments extending longitudinally along an inner face of said outer cylindrical surface so as to extend beyond an exposed edge thereof, said brush being rotatably driven about a central longitudinal axis of said cup so as to rotate in a direction downwardly across a top surface of the strip and against the direction of strip travel.

2. The apparatus of claim 1 wherein said brush comprises steel filaments having a diameter within the range of 0.002 to 0.0012 inches.

3. The apparatus of claim 2 wherein said filaments have a diameter within the range of 0.004 to 0.008 inches and an exposed length not greater than ¾ inch.

4. The apparatus of claim 3 wherein said drive means rotates said brush at a speed within the range of 1000 to 3400 revolutions per minute.

5. The apparatus of claim 1 further comprising a cover mounted over said brush, a collection tank connected to said cover, and means for exhausting gas from said cover and collecting particles of plated metal in the tank as they are removed from the strip by the brush.

6. The apparatus of claim 1 further comprising a pair of tracks extending in said transverse direction, said carriage being slidably movable on said tracks, said tracks having an inverted V-shape for dissipating plated metal particles and preventing them from collecting on the tracks and interfering with movement of the carriage.

7. Apparatus for removing excess plated metal from the narrow face of the edges of electroplated metal strip as the strip travels through a strip processing line, said apparatus comprising:

a brush;

a carriage for supporting said brush, said carriage being slidably movable in a transverse direction with respect to the strip, means mounted on said carriage for rotatably driving said brush, means for slidably moving said carriage inwardly and permitting movement outwardly in said transverse direction to maintain said brush in contact with the narrow face of said strip edge and so that said brush exerts substantially constant pressure thereagainst, said brush comprising a cup having an outer cylindrical surface and filaments extending longitudinally along an inner face of said outer cylindrical surface so as to extend beyond an exposed edge thereof, said brush being rotatably driven about a central longitudinal axis of said cup, a cover mounted over said brush, a collection tank connected to said cover, and means for exhausting gas from said cover and collecting particles of plated metal in the tank as they are removed from the strip by the brush.

8. Apparatus for removing excess plated metal from the narrow face of the edges of electroplated metal strip as the strip travels through a strip processing line, said apparatus comprising:

a brush;

a carriage for supporting said brush, said carriage being slidably movable in a transverse direction with respect to the strip, means mounted on said carriage for rotatably driving said brush, means for slidably moving said carriage inwardly and permitting movement outwardly in said transverse direction to maintain said brush in contact with the narrow face of said strip edge and so that said brush exerts substantially constant pressure thereagainst, said brush comprising a cup having an outer cylindrical surface and filaments extending longitudinally along an inner face of said outer cylindrical surface so as to extend beyond an exposed edge thereof, said brush being rotatably driven about a central longitudinal axis of said cup, a pair of tracks extending in said transverse direction, said carriage being slidably movable on said tracks, said tracks having an inverted V-shape for dissipating plated metal particles and preventing them from collecting on the tracks and interfering with movement of the carriage.

* * * * *